US006258463B1

(12) United States Patent
Corridan

(10) Patent No.: US 6,258,463 B1
(45) Date of Patent: Jul. 10, 2001

(54) ANODIZED CRYOGENICALLY TREATED ALUMINUM

(75) Inventor: Michael Kevin Corridan, Scottsdale, AZ (US)

(73) Assignee: Praxair S.T. Technology, Inc., North Haven, CT (US)

( * ) Notice: Subject to any disclaimer, the term of this patent is extended or adjusted under 35 U.S.C. 154(b) by 0 days.

(21) Appl. No.: 09/517,341

(22) Filed: Mar. 2, 2000

(51) Int. Cl.[7] ..... B32B 15/04; C22F 1/04

(52) U.S. Cl. ..... 428/472.2; 148/270; 148/275; 148/285; 148/577; 148/695; 148/698; 148/699; 148/700; 148/701; 148/702; 148/415; 148/416; 148/417; 148/437; 148/438; 148/439; 148/440

(58) Field of Search ..... 428/472.2; 148/264, 148/265, 270, 275, 285, 577, 695, 698, 699, 700, 701, 702, 415, 416, 417, 437, 438, 439, 440

(56) References Cited

U.S. PATENT DOCUMENTS

| | | | | |
|---|---|---|---|---|
| 4,739,622 | | 4/1988 | Smith | 62/78 |
| B1 4,159,217 | * | 6/1979 | Selines et al. | 148/577 |

OTHER PUBLICATIONS

Stevenson, Jr., "Anodizing", Surface Engineering ASM Handbook, vol. 5 (1994) pp 482–493. (no month).
Schwartz, "Deposition from Aqueous Solutions: An Overview", Chapter 10, Handbook of Deposition Technologies for Films and Coatings, 2$^{nd}$ Edition, R.F. Bunshah, ed. (1994) pp 480–590. (no month).
Pillai et al., "Deep–Cryogenic Treatment of Metals", Tool & Alloy Steels (1986) pp 205–208. (no month).
Zalud, "New–Wave Treatments Push the Envelope for Age–Old Components", Machine Design (2000) pp 67–74. (no month).

* cited by examiner

*Primary Examiner*—Deborah Jones
*Assistant Examiner*—Robert R. Koehler
(74) *Attorney, Agent, or Firm*—Blake T. Biederman

(57) ABSTRACT

The invention relates to a process for producing anodic coatings with superior corrosion resistance and other properties on aluminum and aluminum alloy surfaces by cryogenically treating the aluminum prior to anodizing. The invention also relates to the anodic coatings and to the anodically coated articles produced by the process. The anodized coating has a thickness of 0.001 to 0.5 mm and a time to penetration of at least 5 hours for aqueous solutions of HCl.

20 Claims, No Drawings

ANODIZED CRYOGENICALLY TREATED ALUMINUM

TECHNICAL FIELD

The invention relates to a process for producing anodic coatings with superior corrosion resistance and other properties on aluminum and aluminum alloy surfaces. The invention also relates to the anodic coatings and to the anodically coated articles produced by the process.

BACKGROUND ART

The formation of protective and decorative oxide coatings on aluminum and aluminum alloys by electrolytically anodizing them is a well-known technology. It has been described in many publications including M. F. Stevenson, Jr., "Anodizing", *Surface Engineering, ASM Handbook*, Volume 5, ASM International, Materials Park, Ohio, 1994, pp. 482–493 and M. Schwartz, "Deposition from Aqueous Solutions: An Overview", Chapter 10, *Handbook of Deposition Technologies for Films and Coatings*, Second Edition, R. F. Bunshah, ed., pp. 480–590 (543–545). The most commonly used methods of anodizing use electrolytes of chromic acid (Type I per specification MIL-A-8625), sulfuric acid (Type II), or cold sulfuric acid (Type III). The coatings produced by each are based on alumina, but are usually not pure alumina. For example, the coatings produced using a sulfuric acid electrolyte may contain about 18% aluminum sulfate and 1 to 6% water in addition to alumina. (Unless otherwise noted, all compositional percentage used herein will be in percent by weight.) The alumina itself is commonly a hydrated alumina, $2Al_2O_3.H_2O$. The oxide coatings are porous and must be sealed to provide adequate corrosion resistance for the aluminum substrate. Hot sealing with pure water may change the alumina coating to $Al_2O_3.H_2O$ which presumably increases the volume of the alumina and decreases the porosity. Other sealants, such as dichromates or silicates, tend to form precipitates in the pores, effectively blocking them.

Semiconductor manufacturers extensively rely on anodized aluminum for tooling devices inside of semiconductor processing chambers. These chambers require tooling having both the dielectric and corrosion protection of anodized aluminum. With the use of more aggressive process gases and the increase in processing voltages and temperatures, tooling anodized by current methods is becoming inadequate for semiconductor processing chambers.

Cryogenic treatment of metals is well known, see, for example, R. M. Pillai, et al, "Deep-Cryogenic Treatment of Metals", Tool & Alloy Steels, June 1986, pp. 205–208. Cryogenic treatments include those that lower the temperature of the part to a) about −109° F. (−79° C.) using solid carbon dioxide blocks in an insulated chamber containing the part or carbon dioxide to lower the temperature of an organic liquid in which the part is immersed, b) about −112° F. (−80° C.) in a mechanical refrigerator, or c) about −321° F. (−196° C.) by immersion in liquid nitrogen. One of the cryogenic treatments most commonly done is immersion of the part to be treated in liquid nitrogen (sometimes called deep cryogenic treatment), since, generally speaking, the lower the cryogenic temperature, the more effective the treatment. The effect of the treatment varies from alloy to alloy. One of the most common uses of the treatment results in a more complete transformation of retained austenite to martensite and refined precipitation of carbides in some tool steels. In this case, the resulting change in microstucture and other properties increases resistance to wear.

Aluminum alloys have also been cryogenically treated. Most commercially available alloys fall into the following classification:

2xxx alloys of Al—Cu and Al—Cu—Mg

3xxx alloys of Al—Mn—Cu

5xxx alloys of Al—Mg

6xxx alloys of Al—Mg—Si

7xxx alloys of Al—Zn—Mg—Cu

In the case of typical cast alloys the improvement in properties due to cryogenic treatment is attributed to plastic flow during the cooling and reheating of the alloy which alleviates microstrain within the alloy. In work hardened alloys improvements may be due to more complete transformation of phases, and in alloys that can be precipitation hardened improvements may be due to more complete or widely distributed precipitation. Virtually all of the cryogenic treatment of aluminum alloys to date has been directed at increasing resistance to wear and improved mechanical properties.

It is an object of the present invention to provide superior anodic coatings on aluminum or aluminum alloys.

It is a particular object of the present invention to provide anodized coatings having superior corrosion resistance.

It is also an object of the present invention to provide a process for the production of superior anodized coatings on aluminum or aluminum alloys.

It is a particular object of the present invention to provide a process for producing anodized coatings with superior corrosion resistance.

It is yet a further object of the present invention to provide articles of aluminum or aluminum alloys, such as tooling for semiconductor processing chambers, with superior anodized coatings.

It is yet a further object of the present invention to provide articles of aluminum or aluminum alloys, such as tooling for semiconductor processing chambers, with anodized coatings having superior corrosion resistance.

SUMMARY OF THE INVENTION

The invention provides a process for producing superior anodized coatings. It includes the steps of cryogenically treating an aluminum or aluminum alloy substrate. The aluminum or aluminum alloy substrate has an outer surface. Then anodizing the cryogenically treated aluminum or aluminum alloy substrate converts the outer surface of the aluminum or aluminum alloy substrate into an anodized layer. The anodized substrate's coating has a thickness of 0.001 to 0.5 mm and a time to penetration of at least 5 hours for aqueous solutions containing 5 to 7 percent HCl.

DETAILED DESCRIPTION

Surprisingly, it has been found that cryogenically treating aluminum alloys changes the properties of the alloy in such a manner that subsequent anodizing yields a coating that is substantially superior, particularly in corrosion resistance, to the same alloy that has not been given the cryogenic treatment prior to anodizing. The amount of improvement due to the cryogenic treatment may be a function of a number of variables including a) the specific alloy composition and its prior mechanical working and heat treatment, b) the specific cryogenic treatment, and c) the specific anodizing process that is used.

The structure and properties of the aluminum alloy prior to cryogenic treatment may be, as noted above, a function of its thermomechanical history. Further, this initial condition of the alloy may have a bearing on the extent to which the cryogenic treatment changes the structure and properties of the alloy. For example, the extent of change may be different for an alloy such as 6061 in a fully annealed condition or in a T-6 condition. (Aluminum alloy 6061, has a nominal composition by weight of Al-1Mg-0.6Si-0.25Cu-0.20Cr. The fully annealed condition indicated the alloy has been held at 775° F. (412° C.) for 2 to 3 hours and cooled at a rate of not greater than 50° F./h (28° C./h) to less than 500° F. (260° C.), with subsequent cooling at any rate. The T6 condition indicates the alloy has been solution treated and aged at 320 to 350° F. (160 to 176° C.) for 8 to 18 hours.) In spite of a difference in the extent of change due to cryogenic treatment, some improvement in the properties of a subsequently grown anodic coating may be expected. The amount of improvement may also be a function of the specific cryogenic treatment. It is anticipated that lowering the temperature decreases treatment time required and improves the ultimate anodized coating.

A cryogenic temperature as high as about −70° C. or below may provide some improvement, depending upon the work history of the substrate. Advantageously, the cryogenic treatment is at a temperature of about −150° C. for significant improvement after anodizing. While any of the treatments noted above or others may be used, treatment at or near liquid nitrogen temperatures of about −180° C. or below is preferred. The substrate's outer surface is at temperature advantageously at least about 0.1 hours and most advantageously, at least about 1 hour. When treating the part it is possible to have the part's center at a greater temperature than its outer surface. This however is not advantageous, because it induces thermal stresses into the substrate. The part is typically cooled to less than −310° F. (−190° C.) and held at that temperature for about 24 hours. The rate at which the temperature is both lowered and allowed to rise back to ambient is very carefully controlled to avoid thermal shock.

The cryogenic process ultimately forms an anodized coating having a thickness of about 0.001 to 0.5 mm. Most advantageously, the final coating has a thickness of about 0.002 to 0.15 mm. This anodized coating unexpectedly doubles time to penetration for aqueous solutions of HCl. In particular, the coating has a time to penetration of at least about 5 hours for aqueous solutions containing 5 to 7 percent HCl. Most advantageously, it has a time to penetration of at least about 10 hours.

The properties of the anodic coating will also be a function of the specific anodizing process that is used. Advantageously, the process uses a sulfuric acid-containing electrolyte. The preferred method is Mil Spec Type III noted above. It is also expected that the coating will be sealed after it is formed. The sealant used is a function of the intended application. For example, the preferred sealant for semiconductor manufacturing equipment is hot deionized water.

There are many potential applications for the present invention. Coatings produced on aluminum by anodization are used for corrosion resistance, wear resistance, electrical resistance, for decorative purposes, and for other reasons. Cryogenic treatment prior to anodization may enhance the performance of the coatings in each of these types or categories of applications. Corrosion resistance is a particularly important type of application. Aluminum or aluminum alloys are used in a wide variety of applications including semiconductor process tooling, electronic packaging, aerospace (particularly airframe structural components), internal combustion engines, automotive radiators and structural components, heat exchangers for air conditioning refrigeration, architectural components (panels, roofing, hardware, etc.), and coaxial cables. In all of these and other applications the corrosion resistance of the aluminum is improved by using anodized coatings, and in all of them the corrosion resistance may be very substantially improved using cryogenic treatment prior to anodization.

Other applications for anodized aluminum may also benefit substantially from the present invention. These include those applications requiring a coating with superior wear resistance or electrical resistance. Of particular importance are those applications requiring a combination of superior corrosion resistance and superior wear or electrical resistance.

The following example provided below illustrates the present invention. It is illustrative and not limiting in any way.

EXAMPLE

An evaluation of the properties of two anodized aluminum alloys, 6061-T6 and 5052-H32, were compared with and without cryogenic treatment prior to anodizing. Aluminum alloy 6061 has a nominal composition by weight of Al-1Mg-0.6Si-0.25Cu-0.20Cr. The T6 suffix indicates the alloy has been solution treated and aged at 320 to 350° F. (160 to 176° C.) for 8 to 18 hours. Aluminum alloy 5052 has a nominal composition of Al-2.5Mg-0.25Cr. The suffix H32 indicates the alloy was cold worked to ¼ of its maximum hardness and stabilized at 120 to 177° F. (48 to 80° C.). Sample coupons of each alloy were prepared by shearing 4×4 inch (10.2×10.2 cm) squares out of 0.25 inch (0.64 cm) thick plate. The coupons were double disk ground and their edges broken. A 10–32 hole was drilled and tapped in the center of each plate. Each plate was scribed with an identification code indicating the alloy, coupon number, and if the coupon had been cryogenically treated before anodizing.

Samples that were cryogenically treated were slowly cooled in three stages—first to about −200° F. (−129° C.), then to about −280° F. (−174° C.), then presoaked at −280 to −300° F. (−174 to −185° C.), and finally soaked at −300 to −320° F. (−185 to −196° C.) for about 24 hours. After soaking they were brought back to ambient temperature at a controlled rate. Cooling and reheating rates were carefully controlled to avoid thermally induced stresses.

The samples were then anodized and sealed. Four coupons were attached to a titanium rack using 10–32 aluminum screws for processing in an automated cleaning, anodizing, and sealing line. The steps in the process were as follows:

Cleaning by soaking in a non-etching alkaline bath at 130 to 150° F. (54 to 65° C.) for 3 minutes.

First rinse in water at ambient temperature for 1 minute.

Second rinse in water at ambient temperature for 1 minute.

Third rinse in water with a resistivity of 350 to 1300 K ohms for 1 minute.

Ultrasonically clean in a non-etching alkaline bath at 130 to 150° F. (54 to 65° C.) for 3 minutes.

Rinse in three stages as after cleaning.

Deoxidize and desmut in an acidic bath at 85 to 95° F. (29 to 35° C.) for 1.5 minutes.

Rinse in three stages as after cleaning.

Etch in an alkaline bath at 130 to 150° F. (54 to 65° C.) for 0.5 minutes.

Rinse in three stages as after cleaning.

Repeat deoxidation and rinse.

Anodize in sulfuric acid 30 to 43° F. (−1.4 to 5.8° C.) at the current density and for the time specified.

Rinse in cool water at 60 to 80° F. (15 to 26° C.) for 1 minute.

Rinse in water at ambient temperature for 1 minute.

Rinse in water with a resistivity of 350 to 1300 K ohms at 110 to 130° F. (43 to 54° C.).

Hot seal in deionized water with a resistivity of 180 to 1300 K ohms, pH of 5 to 6.5 at 195 to 212° F. (90 to 100° C.) for the time specified.

Dry.

The non-etching alkaline cleaning bath comprised water plus 5 to 9 vol % Isoprep 44L made by MacDermid. The acid deoxidizing/desmutting bath comprised water plus 13 to 17 vol % Deoxidizer LNC made by Oakite. The alkaline etch bath comprised water plus 4 to 8 vol % Oakite 360L made by Oakite. The anodizing electrolyte comprised water plus 26 to 34 oz microprocessor grade sulfuric acid per gallon water (0.19 to 0.25 liters sulfuric acid/liter water) made by Van Waters and Rogers plus 2 to 6 vol % Anodal EE, an organic acid additive made by Clariant.

The samples were anodized as shown in Table 1. They were then characterized and tested using metallography, microhardness, x-ray diffraction, scanning electron microscopy, energy dispersive x-ray analysis, and cyclic polarization and HCl immersion corrosion tests. Most of the data shown below is based on samples from panels 5052-2, 5052-4*, 6061-1, and 6061-3*.

TABLE 1

Anodizing Parameters

| PANEL | CURRENT DENSITY A/m$^2$ | TOTAL CURRENT A* MIN | VOLTS | THICK -NESS MILS | THICK -NESS (mm) | MAX A/m$^2$ | AVG A/m$^2$ | ANODIZE TEMP. ° C. |
|---|---|---|---|---|---|---|---|---|
| 5052-1 | 1.0 | 524 | 74.8 | 3.3 | 0.084 | 4.0 | 3.8 | 4.6 |
| 5052-2 | 1.0 | 524 | 74.8 | 3.3 | 0.084 | 4.0 | 3.8 | 4.6 |
| 5052-3* | 1.0 | 524 | 74.8 | 3.3 | 0.084 | 4.0 | 3.8 | 4.6 |
| 5052-4* | 1.0 | 524 | 74.8 | 3.2 | 0.084 | 4.0 | 3.8 | 4.6 |
| 6061-1 | 1.0 | 469 | 90.1 | 3.0 | 0.076 | 4.0 | 3.4 | 4.6 |
| 6061-2 | 1.0 | 469 | 90.1 | 3.0 | 0.076 | 4.0 | 3.4 | 4.6 |
| 6061-3* | 1.0 | 469 | 90.1 | 3.0 | 0.076 | 4.0 | 3.4 | 4.6 |
| 6061-4* | 1.0 | 469 | 90.1 | 3.0 | 0.076 | 4.0 | 3.4 | 4.6 |

*Indicates cryogenic heat treatment

In Table 1, mils refers to the thickness of the coatings measured in thousandths of an inch (or as converted to mm) measured with an eddy current device.

Structure and Properties

The surfaces of the coatings on samples that had been cryogenically treated prior to anodizing appeared to be denser than the surfaces of the coatings on samples that had not been cryogenically treated based on scanning electron microscopy.

Hardness changes of either the substrate or the coatings were not significant as a result of cryogenic treatment as shown in Table 2.

TABLE 2

Hardness of Substrates and Coatings

| Sample Description | Substrate Hardness, $HV_{0.1}$ (Kg/mm$^2$) | Coating Hardness, $HV_{0.3}$ (Kg/mm$^2$) |
|---|---|---|
| 6061 | 117 | 335 |
| 6061* | 120 | 336 |
| 5052 | 78 | 356 |
| 5052* | 80 | 369 |

*Indicates cryogenic heat treatment

The x-ray diffraction studies of the coated 5052 samples showed a relatively small change in phase composition with some transformation of beta to alpha with cryogenic treatment. This is to be expected for this class of alloys, since 5052 is not considered a heat treatable alloy. The 6061 samples, however, showed a substantial amount of transformation of the beta to alpha phase. Again, this is to be expected for a heat treatable alloy.

Corrosion

Anodized samples were exposed to aqueous solutions containing 5 to 7% HCl. The time to penetrate the coating was measured as evidenced by blistering of the coating as a result of substrate corrosion. The results are shown in Table 3.

TABLE 3

HCl Penetration

| Sample Description | Time to Penetration, hr |
|---|---|
| 6061 | 2 to 3 |
| 6061* | 12 to 18 |
| 5052 | 4 to 6 |
| 5052* | 12 to 18 |

*Indicates cryogenic heat treatment

A very substantial increase in corrosion resistance for both the 6061 and 5052 alloys resulted from the cryogenic treatment prior to anodization.

The results of the cyclic polarization corrosion tests are shown in Table 4.

TABLE 4

Cyclic Polarization Studies

| Sample Description | Corrosion Potential, Ecorr (volts) | Corrosion Current, Icorr ($A/cm^2$) | Beta C, Taffel Slope (mV/decade) | Beta A, Taffel Slope (mV/decade) | Polarization Resistance, Rp (Ohm × $cm^2 \times 10^8$) |
|---|---|---|---|---|---|
| 6061 | 5.5 | $1 \times 10^{-2}$ | 18.4 | 18.4 | 4 |
| 6061* | −200 | $4 \times 10^{-11}$ | 20 | 60 | 2 |
| 5052 | −700 | $2 \times 10^{-11}$ | 25 | 20 | 3 |
| 5052* | −500 | $22 \times 10^{-11}$ | 22 | 40 | 2 |

*Indicates cryogenic heat treatment

The results of the cyclic polarization studies indicate a very substantial benefit from cryogenic treatment for 6061 aluminum, but not for 5052 aluminum.

Taken together, the HCl immersion tests and the cyclic polarization studies illustrate the value of the present invention. Those alloys which undergo substantial phase changes or other changes during cryogenic treatment yield coatings with very significantly superior corrosion resistance. Even those alloys which undergo less substantial changes yield coatings with improved corrosion resistance. The reasons for these surprising and unexpected results are not well understood, but are thought to be due to the growth kinetics and morphology of the anodically grown coatings.

The process of the invention serves to improve both the properties and the consistency of anodized coatings for aluminum and aluminum-base alloys. Furthermore, the process is effective for work hardened alloys and in particular for aluminum-base alloys prepared with the additional steps of solution treating, quenching, aging, and cold working—before the cryogenically treating of the substrate. This process is effective for aluminum-base alloys containing magnesium and silicon and aluminum-magnesium-chromium alloys. It is particularly effective for aluminum-base alloys 5052 and 6061. The anodized structures facilitate the manufacture of tooling used in semiconductor fabrication chambers for the production of integrated circuits. In addition, the cryogenic annealing provides an effective process for improving the corrosion resistance of aluminum and its alloys.

Many possible embodiments can be made of this invention without departing from the scope thereof, it being understood that all of the matter set forth herein is to be interpreted as illustrative and not limiting in any sense.

What is claimed is:

1. A process for producing anodized coatings comprising the steps of: cryogenically treating an aluminum or aluminum alloy substrate, the aluminum or aluminum alloy substrate having an outer surface; and anodizing the cryogenically treated aluminum or aluminum alloy substrate to convert the outer surface of the aluminum or aluminum alloy substrate into an anodized layer.

2. The process of claim 1 wherein the cryogenically treated aluminum or aluminum alloy substrate has the outer surface at a temperature of about −150° C. or below during the cryogenic treatment and including the additional step of holding the outer surface at the temperature for at least about 0.1 hours.

3. The process of claim 1 wherein the cryogenically treated aluminum or aluminum alloy substrate has the outer surface at a temperature of about −180° C. or below during the cryogenic treatment and including the additional step of holding the outer surface at the temperature for at least about 1 hour.

4. The process of claim 1 wherein the anodizing is a sulfuric acid-containing electrolyte.

5. The process of claim 1 including the additional step of sealing the anodized layer.

6. The process of claim 1 including the additional step of sealing the anodized layer with deionized water.

7. The process of claim 1 wherein the substrate is an aluminum-base alloy containing magnesium and silicon.

8. The process of claim 7 including the additional steps of solution treating, quenching, aging, and cold working before the cryogenically treating of the substrate.

9. The process of claim 1 wherein the anodizing forms the anodized layer on a substrate of aluminum alloy 5052 or 6061.

10. The process of claim 9 wherein the substrate is a tooling device for use in a semiconductor processing chamber.

11. An anodized substrate, the substrate comprising an aluminum or aluminum alloy substrate having a coating produced by first cryogenically treating said substrate and subsequently anodizing said substrate, the coating has a thickness of about 0.001 to 0.5 mm and a time to penetration of at least about 5 hours for aqueous solutions containing 5 to 7 percent HCl.

12. The anodized substrate of claim 11 wherein the substrate is an aluminum alloy comprising aluminum-magnesium-chromium.

13. The anodized substrate of claim 11 wherein the substrate is work hardened prior to cryogenic treatment.

14. The anodized substrate of claim 11 wherein the thickness of the coating is 0.002 to 0.15 mm thick.

15. The anodized substrate of claim 11 wherein the coating is sealed.

16. The anodized substrate of claim 11 wherein the coating is sealed with deionized water.

17. The anodized substrate of claim 11 wherein the substrate is aluminum or aluminum alloy 5052 or 6061.

18. The anodized substrate of claim 17 wherein the substrate is a tooling device for use in a semiconductor processing chamber.

19. An anodized substrate, the substrate comprising aluminum or aluminum alloy substrate having a coating produced by first cryogenically treating said substrate and subsequently anodizing said substrate, the coating has a thickness of about 0.002 to 0.15 mm and a time to penetration of at least about 10 hours for aqueous solutions containing 5 to 7 percent HCl.

20. The anodized substrate of claim 19 wherein the substrate is aluminum alloy 5052 or 6061.

* * * * *